US006949028B1

(12) United States Patent
Hueber

(10) Patent No.: US 6,949,028 B1
(45) Date of Patent: Sep. 27, 2005

(54) GOLF PUTTER ALIGNMENT DEVICE TO CORRECT FOR EYE PREDOMINANCE

(76) Inventor: David B. Hueber, 123 Nandina Cir., Ponte Vedra Beach, FL (US) 32082

( * ) Notice: Subject to any disclaimer, the term of this patent is extended or adjusted under 35 U.S.C. 154(b) by 9 days.

(21) Appl. No.: 10/796,920

(22) Filed: Mar. 10, 2004

(51) Int. Cl.[7] ..... A63B 69/36; A63B 53/04
(52) U.S. Cl. ..... 473/242; 473/249; 473/251
(58) Field of Search ..... 473/242–254, 473/330–331; D21/736–746

(56) References Cited

U.S. PATENT DOCUMENTS

| | | | | |
|---|---|---|---|---|
| 3,033,574 | A | 5/1962 | Partridge | |
| 3,118,678 | A | 1/1964 | Rohr | |
| 3,199,873 | A | 8/1965 | Surratt | |
| D205,041 | S | 6/1966 | Capps | |
| 3,292,928 | A | 12/1966 | Billen | |
| 3,333,854 | A | 8/1967 | White | |
| 3,408,074 | A | 10/1968 | Antonious | |
| 3,680,860 | A | 8/1972 | Elkins, Jr. | |
| 3,884,477 | A | 5/1975 | Bianco | |
| 4,291,883 | A | 9/1981 | Smart et al. | |
| 4,458,900 | A * | 7/1984 | Antonious | 473/254 |
| 4,688,798 | A | 8/1987 | Pelz | |
| 4,762,324 | A | 8/1988 | Anderson | |
| 4,809,977 | A | 3/1989 | Doran et al. | |
| 4,872,683 | A | 10/1989 | Doran et al. | |
| 4,928,971 | A * | 5/1990 | Soles, Jr. | 473/249 |
| 5,169,150 | A * | 12/1992 | Tindale | 473/220 |
| 5,409,228 | A | 4/1995 | Botsch | |
| 5,429,366 | A | 7/1995 | McCabe | |
| 5,447,313 | A | 9/1995 | Finley | |
| 5,716,286 | A | 2/1998 | Swan | |
| 5,792,003 | A * | 8/1998 | Gavranovich | 473/330 |
| 5,839,970 | A | 11/1998 | Lombardo | |
| 5,947,837 | A * | 9/1999 | Perry | 473/313 |
| 6,001,025 | A | 12/1999 | Blackmon | |
| 6,062,986 | A * | 5/2000 | Kaise | 473/242 |
| 6,261,190 | B1 | 7/2001 | Ashcraft | |
| 6,409,610 | B1 | 6/2002 | Ahn et al. | |
| 6,422,949 | B1 | 7/2002 | Byrne et al. | |
| 6,471,600 | B2 | 10/2002 | Tang et al. | |
| 6,506,125 | B2 | 1/2003 | Helmstetter et al. | |
| D471,245 | S | 3/2003 | Tang et al. | |
| D471,940 | S | 3/2003 | Tang et al. | |
| 6,558,268 | B2 * | 5/2003 | Tindale | 473/244 |

* cited by examiner

*Primary Examiner*—Sebastiano Passaniti
(74) *Attorney, Agent, or Firm*—Thomas C. Saitta

(57) ABSTRACT

A golf putter having visual indicia to correct for misalignment caused by eye predominance, the visual indicia being generally D-shaped with the back line linear portion parallel to the clubface and the arc portion facing forward toward the clubface, with a linear alignment line disposed within the arc and back line such that the alignment line is angled a slight amount away from perpendicular to the back line, such that the golfer falsely perceives the alignment line to be perpendicular to the clubface.

41 Claims, 3 Drawing Sheets

GOLF PUTTER ALIGNMENT DEVICE TO CORRECT FOR EYE PREDOMINANCE

BACKGROUND OF THE INVENTION

This invention relates generally to golf putters, and more particularly to golf putters that incorporate mechanisms or indicia to improve alignment of the putter face relative to the target line and/or to improve striking the ball at the proper heel-to-toe position on the clubface. More particularly, the invention relates to golf putters having such alignment/positioning mechanisms or indicia that correct for the error produced by left or right eye predominance.

In the game of golf, consistent putting is one of the main requirements to produce a low score. One of the crucial factors in accurate putting is proper alignment of the clubface to the chosen target line at the point of ball contact during the stroke. The clubface should be perpendicular to the target line when the ball is struck. If the clubface alignment at the point of contact is open (the angle between the target line and the toe side of the clubface is greater than 90 degrees) or closed (the angle between the target line and the toe side of the clubface is less than 90 degrees), the ball will not travel along the intended target line.

Many putters incorporate a short visual alignment line on the top of the putter blade, the line being perpendicular to the clubface, in order to provide a visual reference for the proper clubface alignment. Research shows that about half of all golfers use the line on the top of the putter to align the clubface while the remainder use the leading edge of the putter. It is theorized that the reason many golfers ignore the alignment line and use the leading edge to align the putter perpendicularly to the target line is that the alignment line does not appear to them to be perpendicular to the clubface. This is a result of a condition known as eye predominance, where either the right eye or left eye is dominant when the golfer is comparing the alignment line to the leading edge of the putter clubface and the target line. The dominant eye causes the alignment line to appear to be skewed slightly open or closed relative to the clubface, and the golfer misaligns the putter accordingly.

A simple test for determining eye predominance is to have the golfer point at arm's length to an object in the distance. Without moving the pointer finger, each eye is individually closed. If the golfer has a dominant eye, the finger will remain pointing at the object with that eye open, but will not be pointing at the object with the other eye open. Statistically, about two-thirds of golfers are right eye dominant and about one-third are left eye dominant. A right-eye dominant golfer will tend to misalign the putter in the open position, since to this golfer the alignment line on the putter will falsely appear to be angled slightly above perpendicular, while a left eye dominant golfer will misalign the putter in the closed position, since to this golfer the alignment line on the putter will falsely appear to be angled slightly below perpendicular. The amount of misalignment tends to range from about 0.75 degrees to 2.0 degrees from perpendicular, with a misalignment angle of about 1.25 degrees being most prominent.

General examples of putter alignment devices or structures for providing a visual indicator to the golfer are shown in U.S. Pat. No. 3,033,574 to Partridge, U.S. Pat. No. 3,118,678 to Rohr, U.S. Pat. No. 3,199,873 to Surratt, U.S. Pat. No. 3,333,854 to White, U.S. Pat. No. 4,762,324 to Anderson, and U.S. Pat. No. 5,409,228 to Botsch. These patents show putters having both fixed alignment devices and adjustable alignment devices. The majority of these references show structures that are visually distracting. The least visually distracting structures are shown in the White and Anderson patents, where the alignment line or lines are inscribed or imprinted onto the top of the putter head and are contained within a half-circle outline, where the half-circle is positioned with its curved portion to the rear of the club. This visual design is similar to a well-known system for increasing the likelihood that the ball will be struck at the proper contact point in the heel-to-toe direction, shown for example in U.S. Pat. No. 3,408,074 to Antonious, U.S. Pat. No. 4,688,798 to Pelz, U.S. Pat. No. 4,809,977 to Doran et al., U.S. Pat. No. 4,872,683 to Doran et al., U.S. Pat. No. D471,245 to Tang et al., U.S. Pat. No. D471,940 to Tang et al., U.S. Pat. No. 6,471,600 to Tang et al., and U.S. Pat. No. 6,506,125, where golf ball sized circles or half-circles are mounted on the putter so as to be visible to the golfer from above. These designs operate on the theory that it is easier visually during the forward putting stroke to align one or more golf ball sized circles or half-circles with the actual ball being struck. None of these patents, however, are concerned with correcting misalignment due to right or left eye predominance, due to the fact that they do not incorporate alignment lines which can be visually misperceived and are attempting to provide visual alignment indicators of sufficient size and shape such that eye predominance will have a reduced detrimental effect on the proper alignment of the putter.

Several patents directly address the problem of eye predominance. For example, U.S. Pat. No. 3,680,860 to Elkins, Jr., discloses a mallet putter (a putter with a large, elongated head, as opposed to a blade putter) having a wide alignment stripe with a centered alignment line positioned on top of the club head, where the alignment line is angled so as to be non-perpendicular to the clubface. Obviously, the width and length of the stripe and line precludes use of the structure on blade putters. U.S. Pat. No. 5,839,970 to Lombardo shows an alternative approach to accounting for eye predominance that also requires a mallet putter. Multiple lines are provided, with the particular alignment line chosen on the basis of the distance of the putt. This system fails to take into account that the golfer should be aligning each point with a target line passing through a point at most a few feet in front of the ball, and therefore the multiple lines serve no useful purpose and will be detrimental to proper alignment. A better solution is provided in U.S. Pat. No. 5,429,366 to McCabe. This device provides a cylindrical module bearing an alignment line on one end, with the module mounted in the putter head such that the line can be rotated about the central axis of the module. Thus, to correct for eye predominance the module is rotated a slight amount and then fixed in place. A drawback to this design is that the line rotates about the axis of the module, such that the front end of the line will be shifted slightly left or right of the ideal heel-to-toe striking point and the back end of the line will be shifted slightly to the opposite side of the ideal heel-to-toe striking point. Thus, correction of the eye predominance affect results in a tendency for the golfer to strike the ball either too close to the toe or to close to the heel, since the golfer's eyesight is focused on the front of the alignment line. In addition, because the modular is circular when viewed from above, the golfer lacks additional reference indicia in order to ascertain that the clubface is perpendicular to the target line.

It is an object of this invention to provide a golf putter having alignment indicia that corrects the problem of misalignment caused by eye predominance, in a manner that is not visually distracting to the golfer and that does not detrimentally alter the balance, physical structure or performance characteristics of the putter. It is a further object to provide such a golf putter that does not suffer the drawbacks of previous attempts to address this problem.

SUMMARY OF THE INVENTION

The invention comprises a golf putter having visual indicia mounted on the upper surface of the club head so as to be visible to the user during initial alignment of the putter to the ball and during the swing. The visual indicia comprises a closed half-circle or generally D-shaped truncated circle of lesser area than a half-circle, defined geometrically as a segment bounded by an arc and a chord, the radius of the arc preferably being approximately equal to the radius of a regulation golf ball, and an alignment line disposed between the arc and the back line. The visual indicia is disposed on the club head so that the arc faces to the front of the club and the chord or back line faces to the rear of the club. The back line of the visual indicator is disposed parallel to the clubface, such that it is perpendicular to the intended target line when the putter is properly aligned. The alignment line is disposed slightly left or right of perpendicular to the back line, preferably from about 0.75 to 2.0 degrees off perpendicular, and most preferably about 1.25 degrees off perpendicular. The alignment line may extend fully from the arc to the back line or may be slightly truncated at one or both ends. Preferably, the alignment line is separated from the arc a short distance and a dot is disposed in between the forward end of the alignment line and the arc. Preferably, the segment defined by the arc and chord is colored white to simulate the look of a golf ball, with the alignment line being provided in a contrasting color to increase visibility.

For a right-handed golfer having right eye dominance, the alignment line is angled toward the heel of the club, such that the golfer will not mistakenly open the clubface during initial alignment and stroke, since the alignment line will appear to the golfer to be perpendicular to the clubface. For a right-handed golfer with left eye dominance, the alignment line is angled toward the toe of the club, such that the golfer will not mistakenly close the clubface during initial alignment and stroke.

DETAILED DESCRIPTION OF THE INVENTION

With reference to the drawings, the invention will now be described with regard for the best mode and the preferred embodiment. In general, the invention is a golf putter, a club designed for use primarily on or adjacent a green such that accurate linear motion will be imparted to the golf ball when it is struck. Most putters are described as being either a blade-type putter or a mallet-type putter, although there are many variations of each type and other non-traditional structural designs not falling into either of these types are also known.

Figure 1:
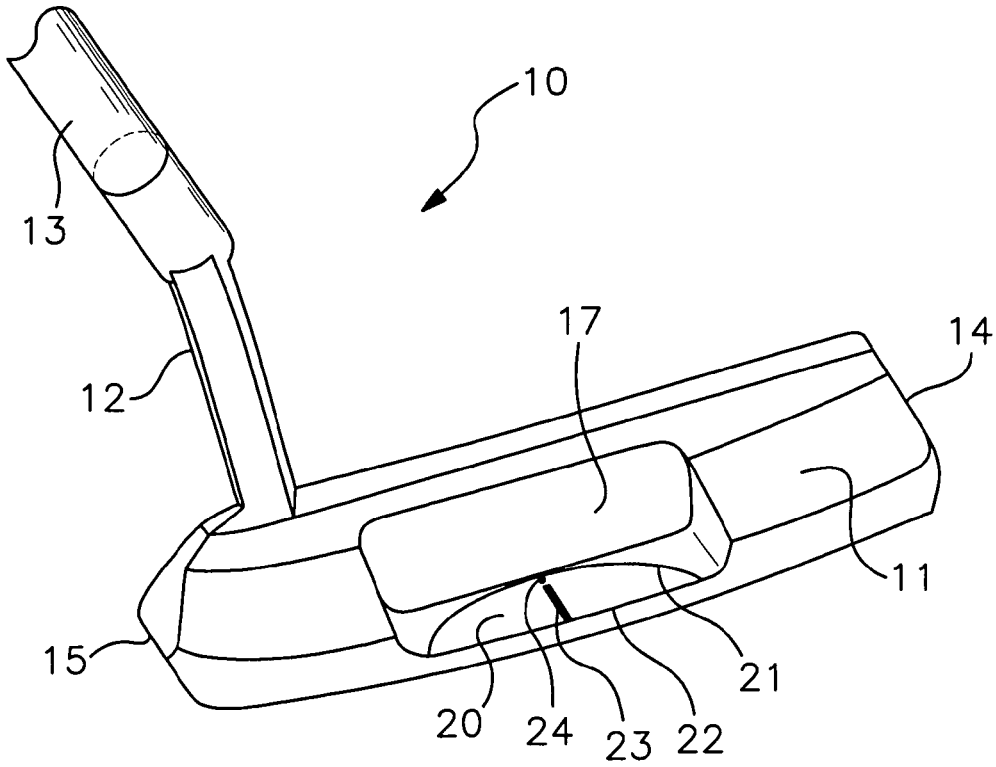
FIG. 1 is a perspective view of an embodiment of the invention.
Figure 2:
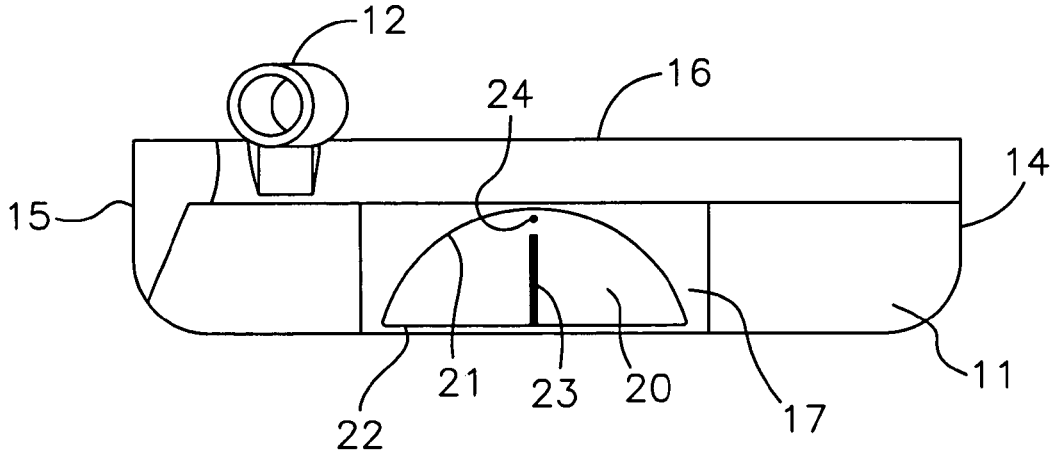
FIG. 2 is a top view of the invention, with the putter shaft removed for clarity.

A representative golf club putter 10 of generally known design is shown in FIGS. 1 and 2, but it is to be understood that the invention is applicable to putters of any design, whether it be a blade, mallet, or non-traditional design. The putter 10 comprises a club head 11 joined to a shaft 13 by a hosel 12. The club head 11 comprises a toe 14 at its distal end, a heel 15 at its proximal end, and a planar clubface 16 that is the forward surface for striking the golf ball 90. The clubface 16 has an optimum striking point 18 located between the toe 14 and heel 15 where minimal flexing or rotation of the clubface 16 occurs when the ball 90 is struck. In the putter 10 illustrated, a cavity 17 is provided in the club head 11 and the rear portion of the club head 11 is reduced in the vertical dimension.

In putting the golf ball 90, the golfer must choose a target line 99. The target line 99 is defined as the optimum initial linear line of travel for striking the golf ball 90, taking into account any sloping of the green that will cause the ball 90 to curve, such that with the proper speed the ball 90 will be hit into the cup. Many golf instructors emphasize picking an aiming point a few inches to a few feet in front of the ball 90 and imagining a line passing from that point through the center of the golf ball 90. That imaginary line is the target line 90, and the best putting stroke brings the optimum striking point 18 forward along the target line 99 to strike the ball 90 with the clubface 16 aligned perpendicularly to the target line 99, such that the ball 90 will pass directly over the chosen aiming point.

To correct the tendency of golfers having eye predominance to misalign the clubface 16 such that it is not perpendicular to the target line 99 at impact, visual indicia means 20 is provided on the club head 11 such that it is visible to the golfer during address and putting. The visual indicia means 20 may be attached or adhered to, imprinted on, inscribed in or raised above the surface of the putter 10. The visual indicia means 20 comprises, in the geometric sense, a segment of a circle defined by an arc 21 and a chord, wherein the chord defines a back line 22, as well as a linear alignment line 23 disposed within the arc 21 and back line 22. Thus the visual indicator means 20 is generally D-shaped overall. The curved portion or arc 22 is oriented or faces toward the clubface 16 with the back line oriented toward the rear of the club head 11. The back line 22 is disposed so as to be parallel to the clubface 16. Preferably, the circle segment is equal to or less than a half-circle in area. Most preferably, the radius of the arc 21 is approximately equal to the radius of a regulation golf ball 90 and the interior area defined by the arc 21 and back line 22 is a white color. The arc 21 and back line 22 may be presented in a contrasting color to the interior.

Figure 5:
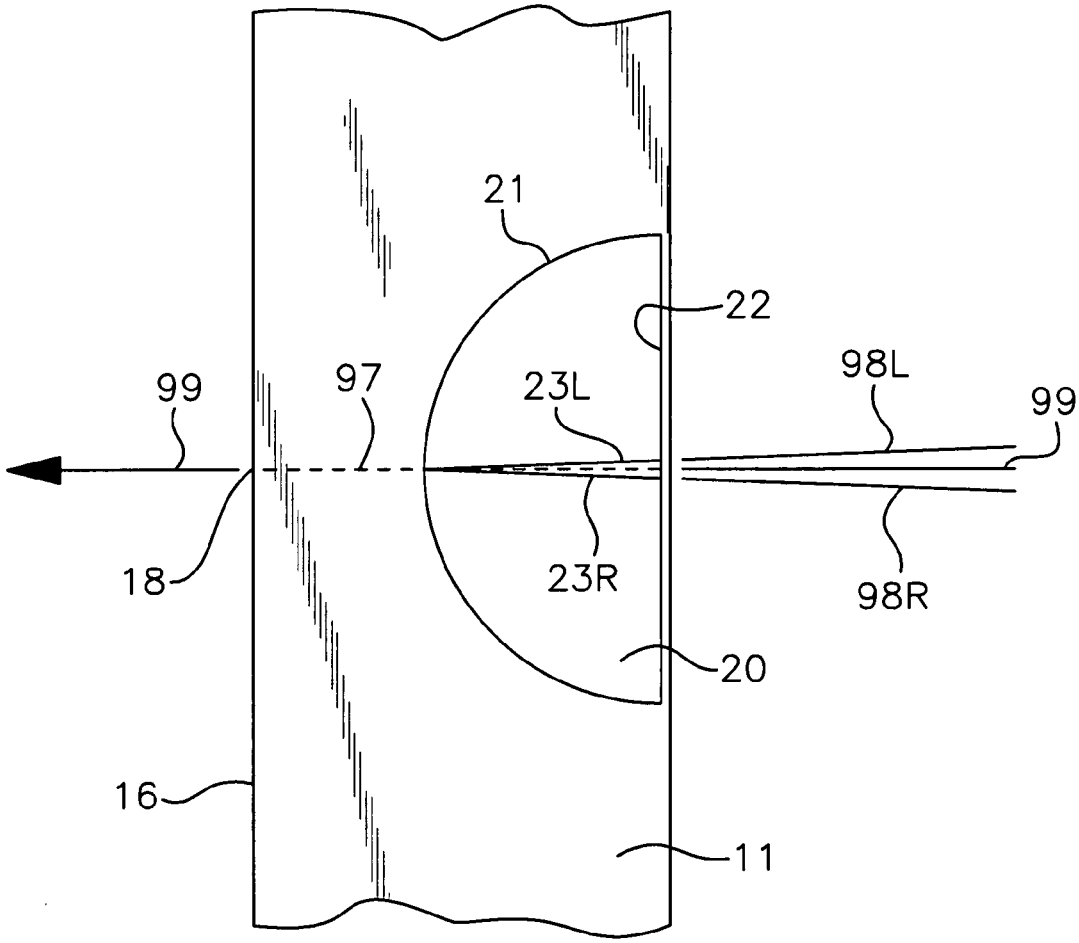
FIG. 5 is a diagram showing part of the putter and the visual indicator in larger detail, illustrating the angular adjustment between the alignment line and the target line for right and left eye dominant golfers.

The visual indicator means 20 is located in the heel-to-toe direction such that the midpoint of the back line 22 and the midpoint of the arc 21 are aligned with the optimum striking point 18 of the clubface 16. The midpoint of the back line 22 is positioned such that an imaginary line 97 extending from the optimum striking point 18 to the midpoint of the back line 22 is perpendicular to the clubface 16 and to the back line 22, as shown in FIG. 5. This imaginary line 97 also passes through the midpoint of the arc 21. Furthermore, with the correct alignment position for the clubface 16 defined as being perpendicular to the target line 99 with the target line 99 passing through the optimum striking point 18 on clubface 16, the target line 99 and the imaginary line 97 will be co-linear with the putter 10 correctly aligned and positioned relative to the ball and the target line 99. Thus the target line 99 will pass through the midpoint of the arc 21 and the midpoint of the back line 22, and will be perpendicular to the back line 22 as well as the clubface 16.

The linear alignment line 23 is a visually demarcated member that is readily observed by the golfer relative to its background. For example, where the interior area of the visual indicia means 20 is white, the alignment line 23 may be black, red, yellow, orange or another color of relatively high contrast. The alignment line 23 is disposed within the arc 22 and back line 21, and may contact both the arc 21 and back line 22, may contact one and not the other, or may be truncated so as to contact neither the arc 21 nor the back line 22. Most preferably, the alignment line 23 contacts the back line 22. The alignment line 23 may be attached, imprinted, raised or inscribed on the putter 10.

Figure 3:
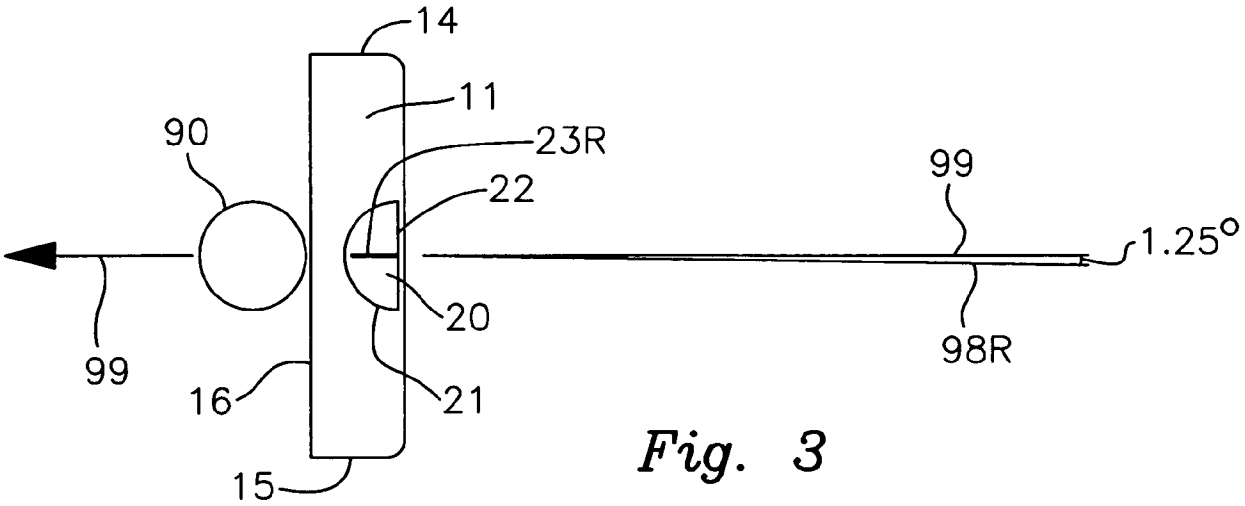
FIG. 3 is a diagram showing the angular adjustment for the alignment line for a right eye dominant golfer.
Figure 4:
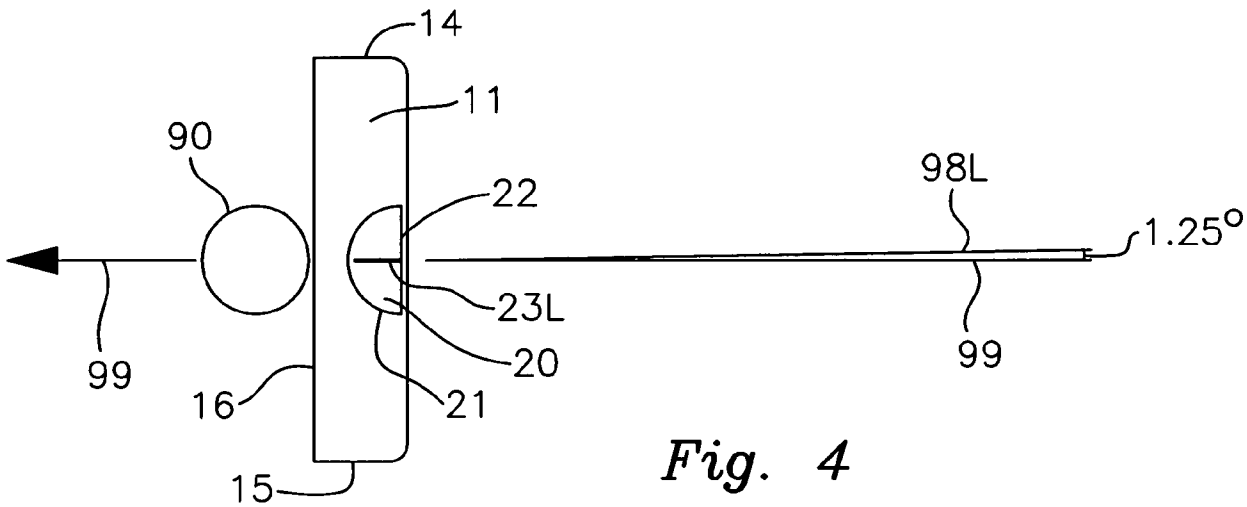
FIG. 4 is a diagram showing the angular adjustment for the alignment line for a left eye dominant golfer.

The alignment line 23 is oriented such that it is non-perpendicular to said back line 22. Likewise, the alignment line 23 is non-parallel with the imaginary line 97 extending from the optimum striking point 18 and the midpoint of the back line 22, and is further non-parallel to the target line 99 when the putter 10 is properly aligned as described above. The alignment line 23 will be angled to one or the other side of the midpoint of the back line 22, dependent on the type of eye predominance being corrected. For a right eye dominant, right-handed golfer, the alignment line 23 will be angled or aligned toward the heel 15 of the club head 11, with the rear portion of the alignment line 23 being nearer the heel 15 than the forward portion. For a left eye dominant, right-handed golfer, the alignment line 23 will be angled or aligned toward the toe 14 of the club head 11, with the rear portion of the alignment line 23 being nearer the toe 14 than the forward portion. Thus, as illustrated in FIGS. 3 through 5, the alignment line 23R or 23L defines a correction line 98R or 98L, respectively, which is non-parallel to the imaginary line 97 or the target line 99. Preferably, the alignment line 23 is angled between approximately 0.7 to 2.0 degrees, and most preferably approximately 1.25 degrees, from perpendicular to the back line, or from the imaginary line 97 or target line 99.

Dependent on the width of the club head 11, the alignment line 23 is aligned in the forward direction with either the midpoint of the arc 22, the optimum contact point 18 or to a point therebetween on imaginary line 97, such that an imaginary extension of the alignment line 23 passes through one of these points. In a most preferred embodiment, the visual indicia means 20 is provided with a dot 24 located between the arc 21 and the forward end of the alignment line 23, such that an imaginary extension of the alignment line 23 passes through the dot 24.

In use, the invention corrects misalignment problems caused by eye predominance in the following manner. With the golfer concentrating on the alignment line 23 as the point of reference for correctly aligning and positioning the clubface 16 relative to the golf ball 90 and the target line 99, the tendency to open or close the clubface 16 relative to the target line 99 is overcome due to the fact that the golfer now falsely perceives the alignment line 23 to be perpendicular to the clubface 16 and parallel to the target line 99 due to the distortion effects of the dominant eye. The prominence of the back line 22 in combination with the alignment line 23 causes in effect an optical illusion to the golfer such that a false right angle is formed, and thus the back line 22 is correctly aligned in perpendicular manner to the target line 99, insuring that the clubface 16 is also correctly aligned.

It is contemplated that equivalents and substitutions for certain elements set forth above may be obvious to those skilled in the art, and therefore the true scope and definition of the invention is to be as set forth in the following claims.

I claim:

1. A golf putter to correct alignment problems resulting from eye predominance, said putter comprising a club head having a toe, a ball striking clubface and a heel;

and further comprising visual indicia means disposed on said club head, said visual indicia means comprising a segment of a circle defined by an arc and a chord, wherein said arc is oriented toward said clubface and said chord defines a back line oriented parallel to said clubface, and a visible alignment line disposed between said arc and said back line;

wherein said alignment line is non-perpendicular to said back line.

2. The putter of claim 1, wherein said alignment line is aligned with the midpoint of said arc.

3. The putter of claim 1, wherein said alignment line contacts said back line.

4. The putter of claim 1, wherein said alignment line contacts said arc and said back line.

5. The putter of claim 1, wherein the interior defined by said arc and said chord is white.

6. The putter of claim 1, further comprising an alignment dot disposed between said alignment line and said arc.

7. The putter of claim 1, wherein said alignment line is angled between approximately 0.7 and 2.0 degrees from perpendicular to said back line.

8. The putter of claim 7, wherein said alignment line is angled approximately 1.25 degrees from perpendicular to said back line.

9. The putter of claim 1, said putter further comprising an optimum striking point disposed on said clubface, and wherein the midpoint of said arc is positioned on an imaginary perpendicular line extending rearward from said clubface and through said optimum striking point.

10. The putter of claim 9, wherein said alignment line is aligned with said optimum striking point.

11. The putter of claim 1, said putter further comprising an optimum striking point disposed on said clubface, and wherein the midpoint of said back line is positioned on an imaginary perpendicular line extending rearward from said clubface and through said optimum striking point.

12. The putter of claim 1, wherein said alignment line is angled toward said toe to correct for left eye dominance and is angled toward said heel to correct for right eye dominance.

13. The putter of claim 1, further comprising a cavity in said club head, wherein said visual indicator is disposed within said cavity.

14. The putter of claim 1, wherein said segment of a circle is a half-circle.

15. The putter of claim 1, wherein said segment of a circle is less than a half-circle.

16. A golf putter to correct alignment problems resulting from eye predominance, said putter comprising a club head having a toe, a heel, a ball striking clubface and an optimum ball striking point on said clubface;

and further comprising visual indicia means disposed on said club head, said visual indicia means comprising a segment of a circle defined by an arc and a chord, wherein said arc is oriented toward said clubface and said chord defines a back line oriented parallel to said clubface such that an imaginary line passing through said optimum ball striking point and the midpoint of said back line is perpendicular to said club face and to said back line, and a visible alignment line disposed between said arc and said back line;

wherein said alignment line is non-perpendicular to said back line and does not cross said imaginary line.

17. The putter of claim 16, wherein said alignment line is aligned with the midpoint of said arc.

18. The putter of claim 16, wherein said alignment line contacts said back line.

19. The putter of claim 16, wherein said alignment line contacts said arc and said back line.

20. The putter of claim 16, wherein the interior defined by said arc and said chord is white.

21. The putter of claim 16, further comprising an alignment dot disposed between said alignment line and said arc.

22. The putter of claim 16, wherein said alignment line is angled between approximately 0.7 and 2.0 degrees from said imaginary line.

23. The putter of claim 22, wherein said alignment line is angled approximately 1.25 degrees from said imaginary line.

24. The putter of claim 16, wherein said alignment line is angled toward said toe to correct for left eye dominance and is angled toward said heel to correct for right eye dominance.

25. The putter of claim 16, further comprising a cavity in said club head, wherein said visual indicator is disposed within said cavity.

26. The putter of claim 16, wherein said segment of a circle is a half-circle.

27. The putter of claim 16, wherein said segment of a circle is less than a half-circle.

28. The putter of claim 16, wherein said alignment line is aligned with said optimum striking point.

29. A golf putter to correct alignment problems resulting from eye predominance such that the putter will be correctly aligned by a golfer relative to a target line, said target line defined as the optimum initial line of travel for putting a golf ball, said putter comprising a club head having a toe, a heel, a ball striking clubface, and an optimum striking point on said clubface, and wherein said putter is defined to be correctly aligned with said target line when said clubface is disposed perpendicularly to said target line with said target line passing through said optimum striking point;

said putter further comprising visual indicia means disposed on said club head, said visual indicia means comprising a segment of a circle defined by an arc and a chord, wherein said arc is oriented toward said clubface and said chord defines a back line oriented parallel to said clubface, and a visible alignment line aligned between said arc and said back line, wherein said target line passes through the midpoint of said back line and is perpendicular to said back line when said putter is correctly aligned; and wherein said alignment line is non-perpendicular to said back line and is non-parallel to said target line when said putter is correctly aligned.

30. The putter of claim 29, wherein said alignment line is aligned with the midpoint of said arc.

31. The putter of claim 29, wherein said alignment line contacts said back line.

32. The putter of claim 29, wherein said alignment line contacts said arc and said back line.

33. The putter of claim 29, wherein the interior defined by said arc and said chord is white.

34. The putter of claim 29, further comprising an alignment dot disposed between said alignment line and said arc.

35. The putter of claim 29, wherein said alignment line is angled between approximately 0.7 and 2.0 degrees from perpendicular to said back line.

36. The putter of claim 35, wherein said alignment line is angled approximately 1.25 degrees from perpendicular to said back line.

37. The putter of claim 29, wherein said alignment line is aligned with said optimum striking point.

38. The putter of claim 29, wherein said alignment line is angled toward said toe to correct for left eye dominance and is angled toward said heel to correct for right eye dominance.

39. The putter of claim 29, further comprising a cavity in said club head, wherein said visual indicator is disposed within said cavity.

40. The putter of claim 29, wherein said segment of a circle is a half-circle.

41. The putter of claim 29, wherein said segment of a circle is less than a half-circle.

* * * * *